United States Patent [19]

Taipale et al.

[11] Patent Number: 4,964,584

[45] Date of Patent: Oct. 23, 1990

[54] DEVICE FOR FEEDING A TAPE IN SEVERING A WEB

[75] Inventors: Kari Taipale, Ylöjärvi; Timo Ojala, Tampere, both of Finland

[73] Assignee: Oy Tampella AB, Tampere, Finland

[21] Appl. No.: 370,844

[22] Filed: Jun. 23, 1989

[30] Foreign Application Priority Data

Jul. 6, 1988 [FI] Finland ..... 883241

[51] Int. Cl.[5] ..... B65H 19/26; B65H 5/22

[52] U.S. Cl. ..... 242/56 R; 242/74; 226/93; 226/97

[58] Field of Search ..... 242/56 R, 65, 74; 226/93, 97

[56] References Cited

U.S. PATENT DOCUMENTS

| | | | |
|---|---|---|---|
| 3,847,390 | 11/1974 | Dixon . | |
| 4,659,029 | 4/1987 | Rodriguez | 242/56 R |
| 4,711,404 | 12/1987 | Falk | 242/56 R |
| 4,749,139 | 6/1988 | Snygg | 242/56 R |
| 4,757,950 | 7/1988 | Rodriguez | 242/74 X |
| 4,783,018 | 11/1988 | Rodriguez | 242/74 X |

FOREIGN PATENT DOCUMENTS

| | | |
|---|---|---|
| 74679 | 4/1986 | Finland . |
| 447816 | 12/1986 | Sweden . |
| 1135945 | 12/1968 | United Kingdom . |

*Primary Examiner*—Stuart S. Levy
*Assistant Examiner*—Steven M. duBois
*Attorney, Agent, or Firm*—Burns, Doane, Swecker & Mathis

[57] ABSTRACT

A device for feeding a tape which severs a web in a paper or cardboard machine includes a tape and a feeding arrangement for feeding the tape to a space located between a reel spool and a reel drum. The feeding arrangement includes an elongate transfer profile which guides the tape to the space between the reel drum and the reel spool. The transfer profile has an elongate space which is enclosed within a plurality of substantially closed sides and in which the tape travels. One of the substantially closed sides is adapted to permit the tape to emerge from the elongate space.

12 Claims, 2 Drawing Sheets

DEVICE FOR FEEDING A TAPE IN SEVERING A WEB

FIELD OF THE INVENTION

The invention relates to a paper or cardboard machine and more particularly, to a device for feeding a tape which serves a web in a paper or cardboard machine. The device includes a tape and means for feeding the tape to a space between a reel spool and a reel drum, the means for feeding the tape comprising an elongate transfer profile, along which the tape is arranged to be guidcd to the space between the reel spool and the reel drum.

BACKGROUND OF THE INVENTION

A continuous web formed in a paper or cardboard machine is reeled at the end of the machine around a reel spool. As the reel grows to its determined size, a new reeling operation of the web around a new reel spool must be started without interrupting the run. In this situation the web must be severed in a controllable manner and it must be led onto a new, empty reel spool.

Among the methods of transfer, the envelope transfer is commonly used, being suitable on all grades, but as a general rule that method results in a great amount of refuse on the core and it can also cause harmful impacts on the reeling machine. Another method is the so-called gooseneck transfer method, where the above-mentioned problems are not present, but it is suitable only for thin grades. The tape transfer is a third method and a device suitable for accomplishing the transfer is the object of the present invention. In the tape transfer the severing of the web and leading of the web onto a new reel spool is commonly carried out using a tape, which is introduced to a nip located between the reel spool and the reel drum near the ends thereof, whereafter the tape in course of its winding in a spiral-like fashion along the width of the reel spool simultaneously severs the web obliquely and guides the new end of the web following the severing point around the reel spool.

The several operations required by the method, some of them in an inconvenient and partly dangerous work environment, have constituted the problems of the method. For eliminating this drawback several devices have been proposed, which take into account the occupational safety problems and which automatically feed the tape into the aforementioned nip. Such devices are disclosed e.g. in GB-Patent 1,135,945, SE-Patent 447,816 and in FI-publication 74,679 of accepted patent application. In the devices shown by the publications the end of the tape provided with an adhesive layer is inserted with the aid of a suitable auxiliary equipment between the reel spool and the reel drum, and the tape adheres to the surface of the reel spool with the help of the adhesive. In the above-mentioned SE-Patent 447,816 is shown an elongate groove designed for guiding the tape. The tape is fed along this groove towards the nip. By means of air sprays on both sides of the groove the feeding of the tape towards the nip is facilitated. The drawback in the above-mentioned device is the difficulties which are encountered when feeding a slack tape, because a proper air-cushion is not provided. Further, all types of tape have the problem of not being protected well enough in course of the feeding operation. In addition, the groove is not protected well enough against external disturbing factors.

OBJECTS AND SUMMARY OF THE INVENTION

The object of the invention is to obviate the drawbacks, which are due to the technique described hereinabove, and to provide a device, by means of which the transfer of the web can be accomplished automatically, controllably and without problems in the feeding of the tape. For realizing this purpose the device in accordance with the invention is mainly characterised in that the transfer profile comprises an elongate space, which is substantially closed at four sides and inside which the tape is arranged to travel, one of the closed sides of the space comprising a construction, through which the tape can emerge from the closed space. The above-mentioned feature permits the tape to be well protected safely introduced to the nip and allows the tape to emerge out of the transfer profile during the severing of the web despite the closed construction.

According to a preferred embodiment of the present invention one of the closed sides of the closed space is formed of flexible material, at which location said construction allowing the tape to emerge is situated. According to a preferred alternative the flexible material is formed of two elongate strips preferably of plastics material extending in the direction of the transfer profile. A slit forming the above-mentioned construction for the exit of the tape is formed between the free edges of the strips. By virtue of this construction the space is well closed without hampering the exit of the tape. According to an advantageous embodiment conduits for supplying a gaseous medium into the space are connected to the closed space. By virtue of this embodiment an air-cushion can be established and consequently even a slack tape can be fed controllably to the nip.

BRIEF DESCRIPTION OF THE DRAWINGS

The present invention will be described in the following in more detail with references to the accompanying drawings, wherein.

DETAILED DESCRIPTION OF THE PREFERRED EMBODIMENT

Figure 1:
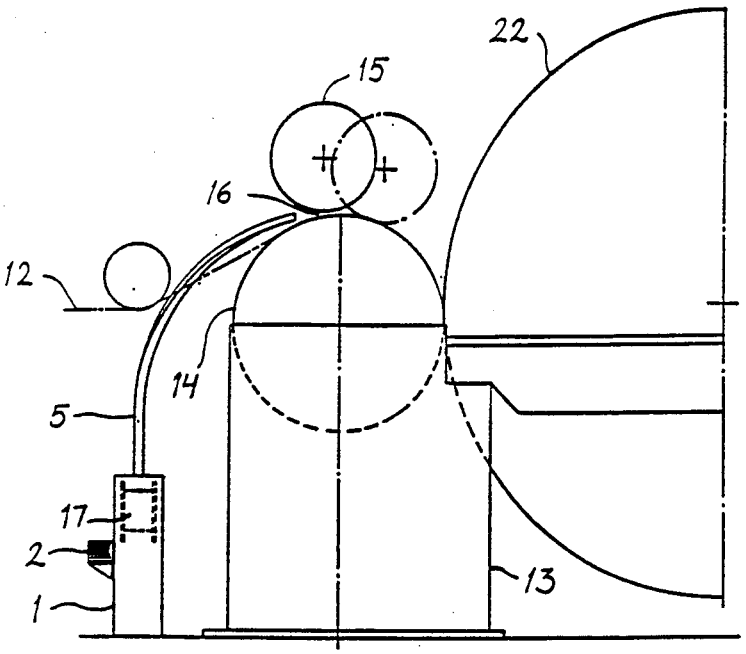
FIG. 1 is a side view of the device of the invention, as seen in the direction of the ends of the spools located at the end of a paper or cardboard machine.

The device shown in the Figures comprises a reel drum 14 rotating on a support 13. A web, denoted by reference numeral 12, is wound via this drum to a paper roll 22. Above the reel drum 14 is situated a reel spool 15 for a new paper roll. The device includes further a transfer profile 5, to be described later on in more detail, for guiding a tape, which is used for severing the web, between the reel drum 14 and the aforementioned reel spool 15. This space is denoted with reference numeral 16 in FIG. 1.

Figure 2:
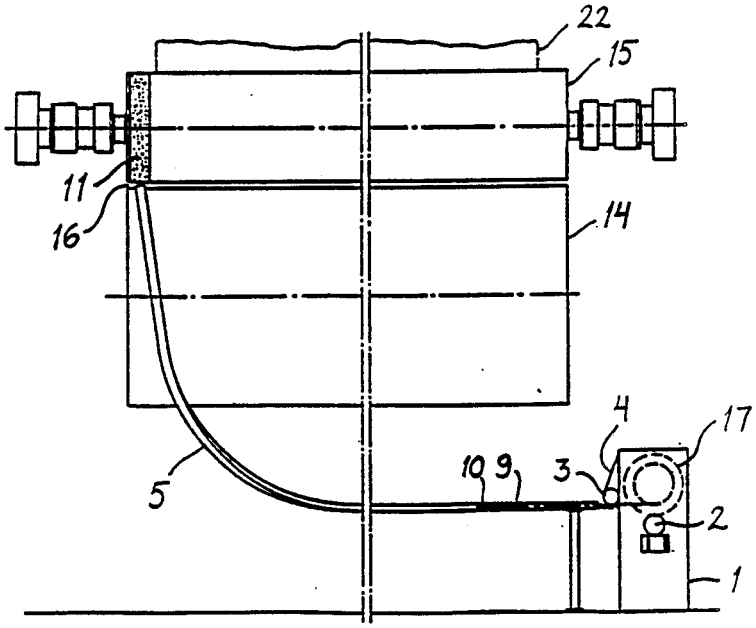
FIG. 2 is a front view of the device of the present invention, as seen in the direction of the web.

The tape 9 to be fed is denoted with a broken line in FIG. 2. The tape is fed along a transfer profile 5 by means of a feeding mechanism 1, which comprises a feed device 2 metering the tape 9 from a storage roll 17 into the transfer profile 5, a brake 3 preventing the free unwinding of the the metered tape, and a tape cutter 4, which automatically cuts the tape 9 to a predetermined length after the severing of the web. The above-mentioned devices are well-known and they are therefore not described in more detail. The transfer profile 5 is situated largely below the web 12 and transversely to its direction of travel. The other end of the transfer profile 5 extends at the ends of the reel drum 14 and the reel spool 15 beyond the edge of the web to the proximity of the space 16 between the reel drum 14 and the reel spool 15.

Figure 3:
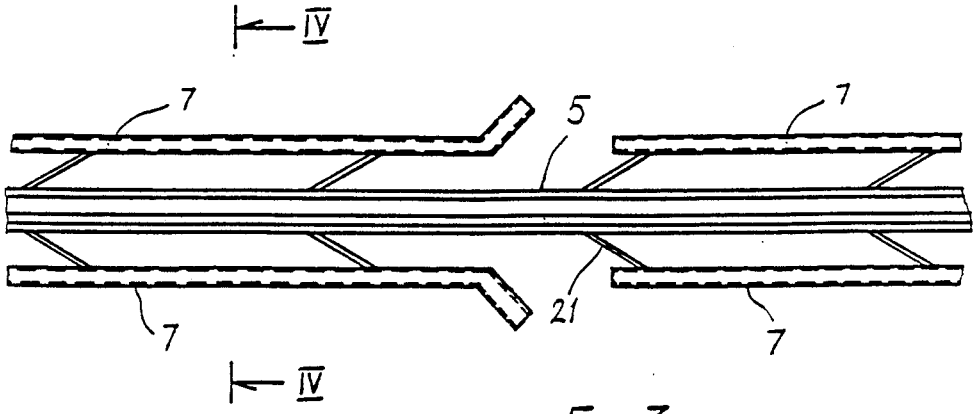
FIG. 3 is a side view of a transfer profile of the present invention used for guiding the tape.
Figure 4:
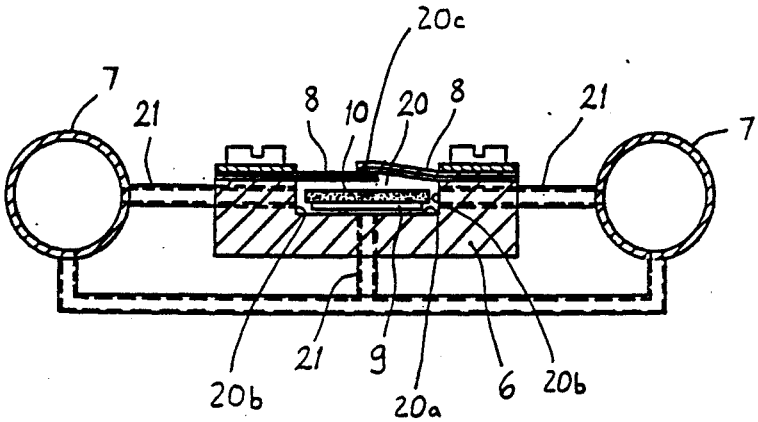
FIG. 4 is a cross-sectional view along line IV—IV of the transfer profile of FIG. 3.

The construction of the transfer profile 5 is shown in more detail in FIGS. 3 and 4. The transfer profile 5 is a closed elongate housing constituted of a body 6 having a depression 20 for longitudinal feeding of the tape 9 and flexible cover strips 8 fixed on the body and covering the depression 20. Hence, the depression constitutes a space substantially closed at four sides, i.e. in the directions of the edges of the tape 9 and in the directions perpendicular to the surfaces of the web. The depression 20 of the body is properly dimensioned in accordance with the dimensions of the tape 9. In the depression there is a bottom wall **20*a* and side walls 20*b* joining the bottom wall at right angles and being situated between the bottom wall and the open side of the recess covered with the cover strips. The width of the bottom wall is larger than the height of the depression (the perpendicular distance from the bottom wall to the cover strips 8). The cover strips 8 are fastened at their edges to both sides of the depression 20 and they are in an overlapping relationship at their free edges forming a slit 20*c* therebetween, which is widened as the strips are bent away from the depression 20. The cover strips 8 are of resilient material and they allow the exit of the tape 9** from between the strips during the severing of the web. In addition, the cover strips are intended for protecting the transfer profile against dust.

On both sides of the transfer profile there are distribution pipes 7 extending parallel to the profile. Air conduits 21 are passed at determined intervals from the pipes to the depression 20 of the body. The conduits 21 are arranged to enter both at the opposite side walls **20*b* and at the bottom wall 20*a* of the depression. The air conduits 21 are directed obliquely to the direction of travel of the tape 9. As the tape is fed within the transfer profile, air is supplied to the depression 20 through distribution pipes 7, the air preventing a wall contact of the tape in the groove by forming an air cushion between the surfaces and at the same time helping the end of the tape to be pushed towards the feeding direction. The tape 9 is so accommodated by the depression 20 that its edges point towards the side surfaces 20*b* and its surfaces lie parallel to the bottom wall 20*a* of the depression. The velocity of air is made greater than the feeding speed of the tape, in which event it may be 10 to 50 m/s when the feeding speed is 0.1 to 1.0 m/s. A piece 10 of adherent material fastened to the end of the tape forms at the end of the tape an area larger in cross section than the rest of the tape 9, forming at the same time a suitable flow resistance to the air and a suitable pressure difference, thus enhancing the feeding of the tape in the transfer profile 5**.

The device in accordance with the invention acts as follows: During preparations for the severing of the web 12 the tape 9 is fed forward a suitable length by means of the feed mechanism 1 along the transfer profile 5 towards the still open space or nip 16 between the reel drum 14 and the reel spool 15. At the end of the tape 9 is arranged a piece 10 adherent material, which is of material capable, of engaging machanically with a zone 11 a adherent material arranged at the end of the reel spool 15. The end of the transfer profile 5, at which the end of the tape 9 emerges, is situated in the direction of width of the spool 15 at the location of the adherent material zone 11 outside the edge of the web. The severing of the web is initiated by lowering the reel spool 15, which earlier has been accelerated to a peripheral speed equal to that of the reel drum 14, to contact with the web 12 on top of the reel drum 14 to a position shown by broken lines in FIG. 1. The devices for accelerating and guiding the reel spool are commonly known and they are therefore not disclosed in more detail herein.

As the nip 16 becomes closed, the end of the tape 9 comes between the reel spool 15 and the reel drum 14 and the adherent material areas 10 and 11 are engaged with each other. The tape 9 is thereafter wound in the conventional manner around the reel spool 15, is tensioned, becomes detached from the transfer profile 5 starting at its free end, gets taut between the nip 16 and the feed device 2 severing off the web and guiding the end of the web following the severing point to the reel spool 15.

The invention is by no means restricted only to the embodiment disclosed in the foregoing description, but it can be modified within the scope of the invention represented by the accompanying claims. In the device according to the invention the areas provided on the surface of the reel spool 15 and on the tape 9 may be of an adherent material engageable with each other mechanically, this combination being described in more detail in another patent application filed by the applicant simultaneously with the present application. In fastening the tape 9 onto the reel spool 15 glue may also be used, for example in such a way that the end of the transfer profile at the spool comprises a device designed to apply the glue onto the end of the tape 9, as for example shown in the SE-Patent 447,816. Moreover, in the foregoing description less attention is paid to the rest of the accessory devices at the end of a papermachine, such as the devices for transferring a full paper roll and the devices for transferring a new reel spool, because they are accessory devices which are independent of the invention. Any devices commonly known in the art may be used as such devices, e.g. devices shown in SE-Patent 447,816.

The principles, preferred embodiments and modes of operation of the present invention have been described in the foregoing specification. However, the invention which is intended to be protected is not to be construed as limited to the particular embodiments disclosed. Further, the embodiments described herein are to be regarded as illustrative rather than restrictive. Variations, changes and equivalents may be made by others without departing from the spirit of the present invention. Accordingly, it is expressly intended that all such variations, changes and equivalents which fall within the spirit and scope of the present invention as defined in the claims, be embraced thereby.

We claim:

1. A device for feeding a tape which is used to sever a web in a paper or cardboard machine, comprising:

a tape;

feeding means for feeding the tape to an area located between a reel spool and a reel drum, said feeding means including an elongate transfer profile which guides the tape to the area between the reel spool and the reel drum, said transfer profile including an elongate space which is enclosed within four substantially closed sides and in which the tape travels, one of said substantially closed sides including means for permitting the tape to emerge from the elongate space;

conduits connected to the elongate space for directing a gaseous medium into the elongate space; and means located at one end of the tape for providing a greater flow resistance to the gaseous medium than the rest of the tape.

2. The device according to claim 1, wherein one of the sides of the transfer profile is formed of a flexible material which permits said tape to emerge from said enclosed elongate space.

3. The device according to claim 2, wherein said enclosed elongate space is formed as a depression in the transfer profile, said depression being covered by said flexible material.

4. The device according to claim 2, wherein said flexible material includes two elongate strips extending along the length of the transfer profile, said means for permitting the tape to emerge from the enclosed elongate space including a slit formed between free edges of the strips.

5. The device according to claim 4, wherein the free edges of the strips overlap one another.

6. The device according to claim 4, wherein said strips are formed of plastic material.

7. The device according to claim 3, wherein said four substantially closed sides include a bottom wall and a side wall extending from both ends of the bottom wall, said bottom wall and said side walls defining the depression in the transfer profile and the width of the bottom wall being greater than the height of the depression.

8. The device according to claim 7, wherein said conduits extend through both side walls of the transfer profile.

9. The device according to claim 7, wherein said conduits extend through said side walls and said bottom wall.

10. The device according to claim 7, wherein said conduits extend through said bottom wall.

11. The device according to claim 1, wherein said means for providing a greater flow resistance includes a separate piece of adherent material secured to the end of the tape.

12. The device according to claim 11, wherein said separate piece of adherent material has a larger cross-sectional area than said tape.

* * * * *